United States Patent [19]

Nelson et al.

[11] 4,149,655

[45] Apr. 17, 1979

[54] DISHWASHER ADDITIVE DISPENSER HAVING A TIMER CONTROLLED CAM MECHANISM

[75] Inventors: Thomas E. Nelson, Anchorage; Thomas E. Jenkins, Louisville, both of Ky.

[73] Assignee: General Electric Company, Louisville, Ky.

[21] Appl. No.: 798,969

[22] Filed: May 20, 1977

[51] Int. Cl.[2] ..... B67D 5/08

[52] U.S. Cl. ..... 222/70; 134/93

[58] Field of Search ..... 222/70, 129, 164, 166, 222/167, 427, 516, 531, 532, 517; 134/56 D, 57 D, 57 DL, 58 D, 58 DL, 93, 95, 100, 101; 68/17 R, 207

[56] References Cited

U.S. PATENT DOCUMENTS

| | | | |
|---|---|---|---|
| 3,102,664 | 9/1963 | Lines | 222/70 |
| 3,125,249 | 3/1964 | Kendt | 134/93 X |
| 3,199,733 | 8/1965 | Perl | 222/516 X |
| 3,344,957 | 10/1967 | Duncan et al. | 134/93 X |
| 3,419,192 | 12/1968 | Wrightenberry | 222/166 |
| 3,426,944 | 2/1969 | French | 134/93 X |
| 3,811,600 | 5/1974 | Allison et al. | 222/70 |

*Primary Examiner*—Robert J. Spar

*Assistant Examiner*—Fred A. Silverberg

*Attorney, Agent, or Firm*—Bruce A. Yungman; Radford M. Reams

[57] ABSTRACT

A dishwashing apparatus having a dispenser operable at a preselected time in the dishwashing cycle for dispensing a treating additive such as detergent. The dispenser is arranged so that in response to a timer controlled cam a spring biased shaft to which the dispenser cover is mounted is released and the cover swings away from the dispenser container opening. The shaft is integral with the cover handle and a detent member. A cam follower operatively interconnects the timer controlled cam and the detent member and holds the detent member from rotating when the cover has properly sealed the dispenser container. The cam follower is slotted at one end and has a spring member attached thereto enabling it to pivot about its point of contact with the timer-controlled cam, said spring providing the engaging force necessary to hold the detent member and also serving to hold the cam follower into engagement with the timer controlled cam. The apparatus is designed to permit optimum opening and closing torque while simultaneously provided for effective operation under maximum manufacturing and assembly tolerance conditions.

8 Claims, 5 Drawing Figures

DISHWASHER ADDITIVE DISPENSER HAVING A TIMER CONTROLLED CAM MECHANISM

CROSS REFERENCE TO RELATED MATTER

This application relates to commonly assigned copending patent applications Ser. No. 798,972 and Ser. No. 798,974, filed on the same date hereof.

BACKGROUND OF THE INVENTION

The instant invention relates to washing apparatus and in particular, to dispensers for dispensing a preselected quantity of detergent additives at a preselected time into washing liquid during a washing operation.

Conventional dishwashers effect cleaning by means of a preselected time sequence of wash and rinse cycles in which different additives are introduced to the dishwashing chamber. Thus, detergent may be dispensed at different times during the wash cycle and rinse additives to provide improved rinsing of the washed dishes may be dispensed during the rinse cycle. Automatic dispensers which operate in preselected timed sequence have been provided in the past to effect the dispensing operation. However, because of the conditions under which such dispensers operate it is desirable to provide such dispensers with a minimal number of moving parts along with substantially clog-free construction. Likewise, for competitive reasons it is desirable to provide such dispensing structures which are extremely simple and economical in construction while still providing positive dispensing with minimum maintenance over long periods of use of the apparatus and elimination of any possibility of leakage.

Treating agent dispensers of the type used in automatic washing machines are typically located on the door of the machine. By opening the door access is provided to the dispenser container for filling the same. When the door is closed against the machine the dispenser container is generally vertical. The dispenser holds the treating agent in a storage position and, typically in response to a timer mechanism, moves the container to a dispensing position. All treating agent dispensers of this type purport to provide a sealed storage position to prevent washing liquid from entering the treating agent container. This is necessary since typically granular treating agents, such as detergents, will cake onto the treating agent container if they become moist or damp. It will be readily apparent that an imperfect seal between the container and its closure will act to retain a substantial portion of the treating agent in the container and may accordingly detract from the washing efficiency of the machine. Conversely, detergent dispensed before being required results in a premature release of chlorine (contained in most detergents) during the pre-wash or fill cycles. This also causes less effective washing.

When perfectly made or when made to rather small tolerances, the devices in the prior art function acceptably to seal the treating agent container in the storage position. It is inevitable in the mass production of automatic washing machines that the treating agent dispenser is subject to manufacturing tolerances of each component thereof as well as assembly tolerances. It will accordingly be apparent that in the mass production of automatic washing machines, manufacturing tolerances can cause inoperative or partially inoperative seals in a sizable percentage of dispensers. Previous devices have been shown such as commonly assigned U.S. Pat. Nos. 3,811,600 and 3,212,675 to overcome the above-described disadvantages and problems, however, even these devices have remained relatively complicated. Another such device is shown in U.S. Pat. No. 3,565,291 which utilizes a solenoid mechanism integral with the dispenser housing for releasing the cover thereby exposing the detergent in response to a signal from the washer timer-programmer. Another solenoid actuated device is shown in U.S. Pat. No. 3,344,957. These devices also have many moving parts, are relatively expensive and require close manufacturing and assembly tolerances.

SUMMARY OF THE INVENTION

The present invention involves an improved dispensing structure for dispensing granular additives into a washing chamber of a washing machine at a preselected time in the washing cycle. In its preferred form, the automatic dispenser of the instant invention is designed for installation in the interior of a bottom hinged door and comprises a main body part formed in the interior surface of the door which acts as an additive storage reservoir. This reservoir or container is supplied by the user with detergent additive when the door is in an open generally horizontal position. A closure device comprising a handle and cover is then rotated over the container and the cover is drawn tight against the container by a further twisting action by the operator; this sealing action is caused by an inclined pin on the handle which is forced against an inclined slot in the cover. The handle is formed integrally with a shaft having a detent mechanism thereon tortionally engaging a cam follower connected to the timer-programmer control unit. The cam follower is spring biased and is adapted to pivot about its point of engagement with the timer controlled cam. The follower continuously tracks the timer controlled cam and serves to react against a retaining surface formed on the detent mechanism thereby holding the container cover in its sealed position. At a preselected time in the washing cycle the follower releases the detent mechanism thereby permitting the cover to swing open. The detent mechanism has an engaging and a retaining surface formed on a radially extending arm extending from the shaft, the surfaces designed to permit optimum engaging closing and holding torque under maximum fabrication and assembly tolerances.

An automatic dispenser for detergents is thus provided having relatively simple and few parts, is relatively easy to assemble, does not require a separate connecting operation between the timer programmer mechanism and the dispenser mechanism, and provides for optimum closing and opening torque of the container cover under wide manufacturing and assembly tolerance conditions for the complete system, and providing excellent sealing characteristics.

BRIEF DESCRIPTION OF THE DRAWINGS

Other features and advantages of the invention will be apparent from the following description taken in conjunction with the accompanying drawings wherein.

DETAILED DESCRIPTION OF THE INVENTION

In the following detailed description of the instant invention the dispenser will be described as being a dispenser of detergent additive but it is readily apparent that the invention is equally applicable to the dispensation of any other such additive. Likewise, the dispenser will be described in association with a dishwasher although it could have equal utility in association with any washing device.

Figure 1:
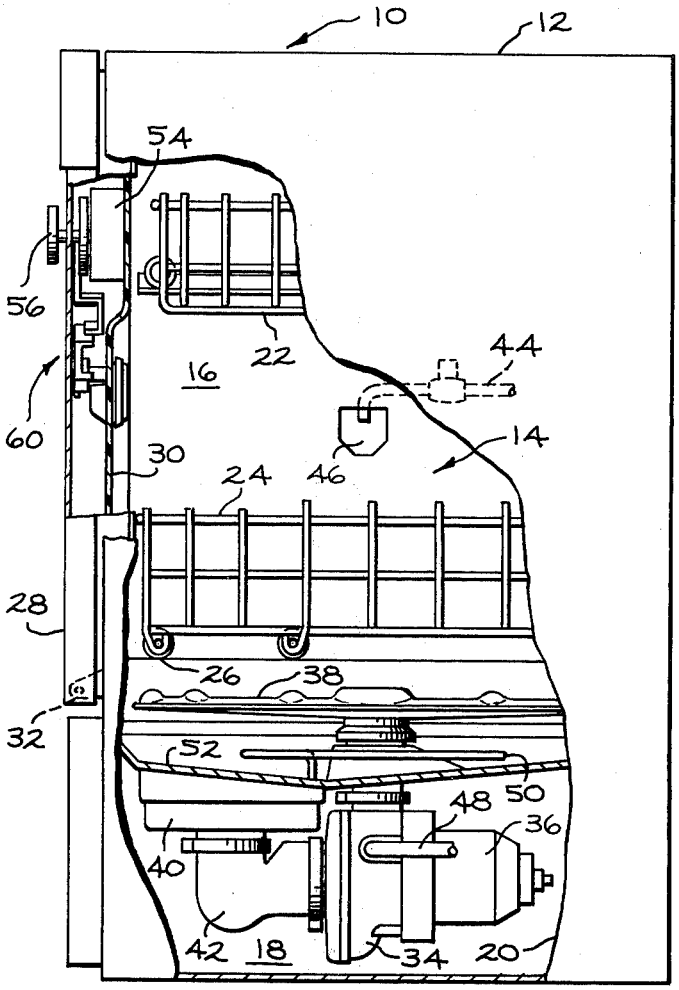
FIG. 1 is a side sectional elevational view of a dishwasher having a dispensing structure embodying the invention, with portions of the dishwasher cut away to facilitate the illustration thereof.

FIG. 1 shows somewhat schematically an automatic dishwasher of a conventional domestic type. The dishwasher 10 includes an outer cabinet 12, and a tub 14 which forms the washing compartment 16 and a machinery compartment 18. The walls 20 of the machinery compartment are formed of metal. The tub 14 may be formed as a one piece structure of plastic or other heat deformable material, such as polypropylene, and is supported on the side walls 20 of the machinery compartment.

Racks 22 and 24 for supporting articles to be washed are mounted within the tub 14. The racks are mounted on rollers, one of which is shown at 26 for permitting the racks to be pulled outwardly of the cabinet to facilitate loading of the articles therein. The tub is provided with a bottom hinged door 28 which is pivotable between its substantially vertical closed position and an open position in which the inner panel 30 of the door is substantially horizontal. The door is supported on hinges 32. As is well known, the dish racks are arranged to be drawn from the tub when the door 28 is open.

In the machine compartment 18 there is disposed a pump 34 which is driven by an electric motor 36. The pump is connected by a conduit to supply water to the reaction type spray arm 38 which is arranged to eject a spray of washing or rinsing fluid over the articles in the dishwasher in a conventional manner. Water flows to a sump 40 from which it is returned to the pump through a conduit 42. Water for operation of the dishwasher is supplied as needed from a regular household water line, indicated at 44. The water is delivered into a fill funnel 46 from which it overflows into the tub and collects in the bottom of the tub. The pump then circulates the water through the spray arm and back through the sump for a period of time sufficient to adequately wash and rinse the articles in the dishwasher. After each washing or rinsing operation is completed the water is discharged by the pump through a conduit 48.

While articles may be dried by merely circulating air thereover, dishwashers are frequently provided with a heating element for insuring complete drying of the articles washed therein. This heating element indicated at 50 in the drawing is positioned near the bottom wall 52 of the dishwasher tub and air heated thereby flows upwardly to effect drying of the articles in the dishwasher. The heating element is conventionally of the sheathed type such as that sold under the trademark Calrod.

The dishwasher has mounted within the door 28 a time cycle controller 54 used to institute an operational program which may include various washing and rinsing operations. The time cycle controller is activated by the user by turning the knob 56 protruding from the front of the dishwasher door. When the dishwasher is loaded and a suitable quantity of detergent added, the door is closed and the user activates the time cycle controller to institute an operational program. During the washing and rinsing operations the pump 34 forces water from the sump 40 up through the spray arm 38 which in turn sprays the articles within the tub. At the end of each washing and rinsing operation the spent liquid is drained from the tub. After a suitable drain interval at the end of the final rinsing operation the Calrod element 50 is energized to dry the washed articles by evaporation of the liquid remaining therein.

The addition of wetting agents and other additives to the final rinse water to improve the drainage of the rinse water from the items being washed is quite common since this minimizes the retention of small rinse water droplets on the washed items which in turn causes spotting due to mineral precipitation on evaporation of the droplets.

The present invention provides apparatus for dispensing additives into a wash chamber of an automatic washing machine such as that described above in response to the programmer-timer control unit 54. As better shown in FIGS. 2 and 3, the dispenser 60 comprises a generally semi-spherical container 62 formed in the wall 30 of the dishwasher door 38. The dispenser includes a cover member 64 mounted to and adapted for rotation about a shaft 66. Shaft 66 is journalled in an opening 68 formed in the dishwasher inner door wall 30. Shaft 66 has a handle portion 70 formed integrally thereon. Cover 64 and handle 70 are interconnected by means of a slot 65 formed in the cover 64 and a pin 71 projecting from the handle 70. Both the slot 65 and the pin 71 are inclined as is better shown and described in copending application Ser. No. 798,972. It will be appreciated that the camming surface formed by the inclined slot and pin forces the cover 64 in an axial direction, as shown by the arrow 2 of FIG. 2, into engagement with a circular projection 63 of inner door wall 30 when the handle 70 is moved in a counter-clockwise direction as shown in phantom by arrow 3 of FIG. 3. The cover 64 is prevented from further rotation by the abutment of a stop which projects from door wall 30 and a shoulder formed on cover 64 (not shown). Conversely, when handle 70 is moved in a counter-clockwise direction the inclined pin 71 reacts against the inclined surface 65 moving the cover 64 off the projection 63 before the handle turns to its open position as shown in phantom in FIG. 4.

Cover 64 has an annular channel 72 formed therein for receiving a resilient circular rubber seal or gasket 74. Of course, gaskets made from other soft sealing material could also be employed, e.g., soft plastic gaskets made from polypropylene or urethane foam.

Figure 3:
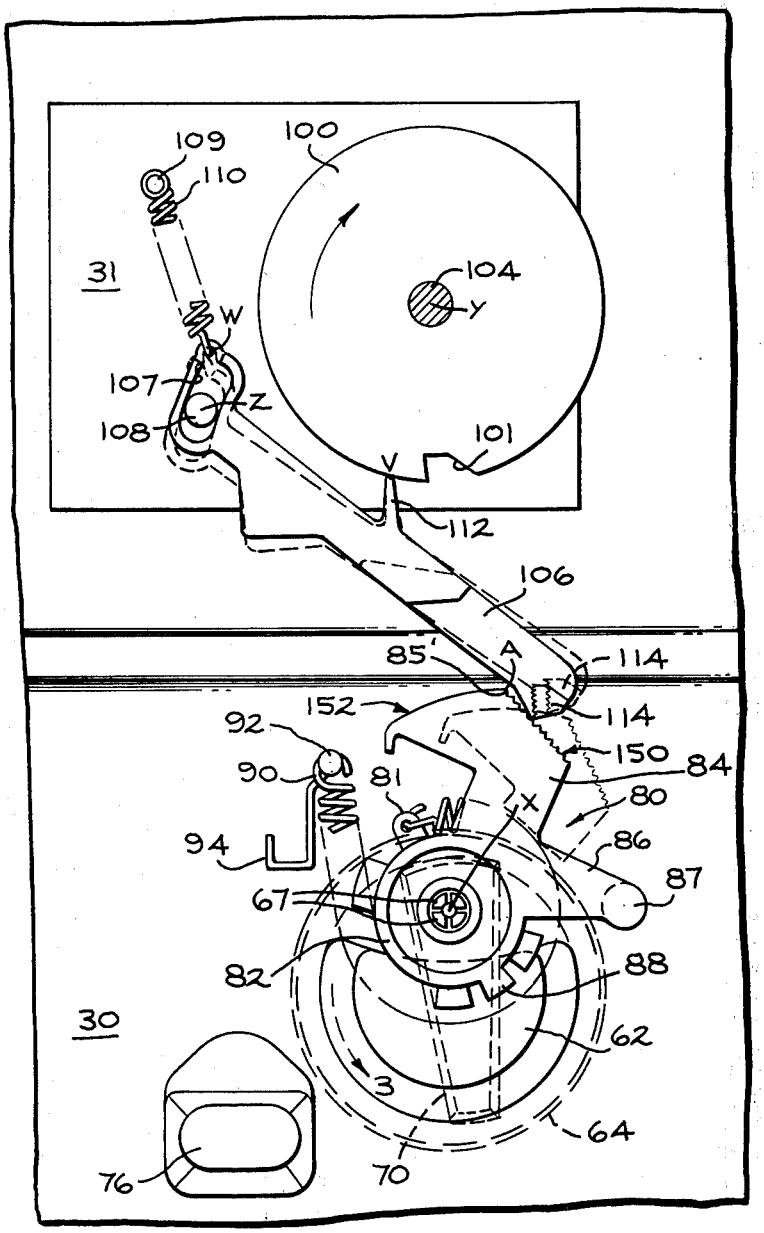
FIG. 3 and 4 are front elevational views of the invention taken along the section line 3—3 of FIG. 2, illustrating the relative positions of the detent mechanism and the cam follower in the closed sealed position and cover open position respectively.

Referring to FIG. 3, it can also be seen that inner wall 30 of the door 28 also has an open detergent receiving container 76 formed therein in close proximity to container 62.

As was discussed above in reference to FIG. 2, shaft 66 is received in an opening 68 formed in the interior wall 30 of the dishwasher door 28. Shaft 66 and its integral handle 70 are preferably formed from a plastic material such as polypropylene and is sealed from the interior of the dishwasher door by a circular seal 78.

Figure 2:
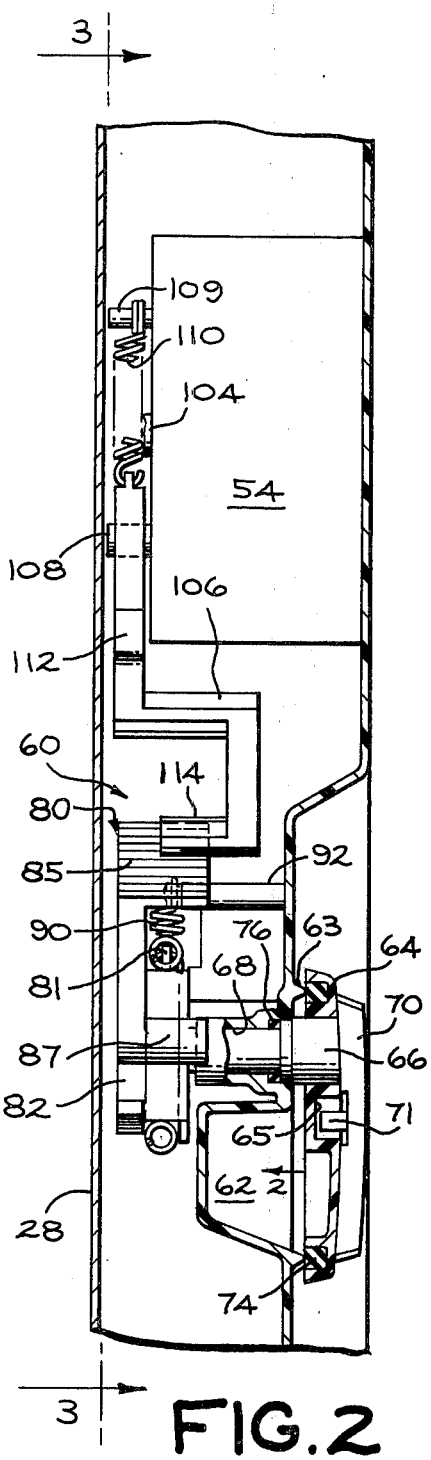
FIG. 2 is an enlarged section of the dispensing structure of this invention as shown in FIG. 1.
Figure 4:
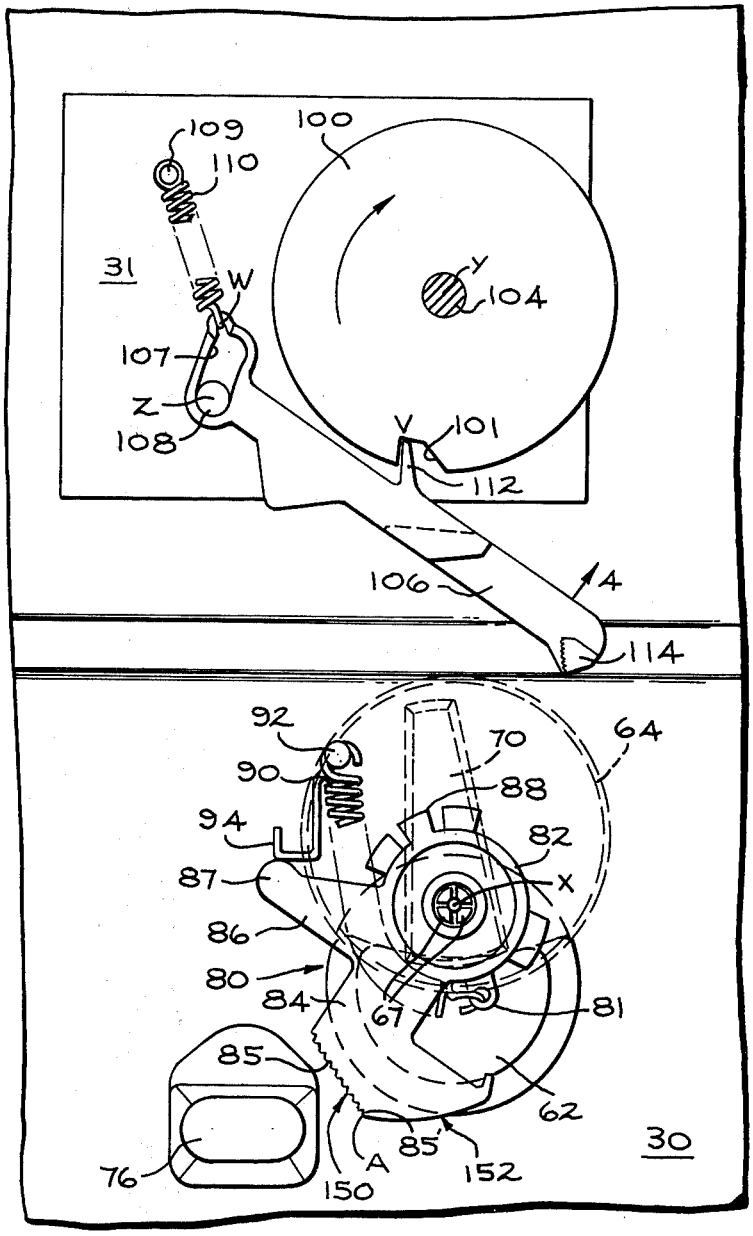

Referring to FIGS. 2 and 3, the detent means 80 will be described. The detent means 80 consists of a generally circular member 82 having a plurality of radial projections formed thereon 84 and 86. This member is also preferably fabricated from a plastic material and is snap fitted for rotation with shaft 66 by means of compressible locking members 67 formed in shaft 66. Other means of joining member 82 to shaft 66 could also be used, e.g., by press fitting, screwing or spin welding. Radial projections 88 formed on member 82 serve to retain a spring 90 wrapped circumferentially around member 82 and connected to projection 81 of member 82 and to a pin 92 which extends from the inner door wall 30. Thus spring 90 causes the shaft 66 and therefore cover 64 to be biased in a clockwise rotational direction (in reference to FIG. 3) toward an open position. Radial extension 84 of member 82 has a plurality of grooves or teeth 85 formed thereon extending in an axial direction as better seen in FIG. 2. The grooves 85 are formed so as to oppose the clockwise rotation of member 82 (as seen in FIG. 4) by reaction of a locking device such as projection 114. Grooves 85 of member 84 begin at 85' which point is selected such that projection 114 does not engage the grooves 85 until there has been minimally acceptable compression of seal 74, thereby assuring an effective seal of container 62. The circumferential or arcuate length of the grooved portion of member 84 is designed to permit wide manufacturing and assembly tolerance variations. Radial projection 86 has a shoulder 87 formed thereon for reacting against a stop member 94 which is formed integrally with and projecting from wall 30.

Figure 5:
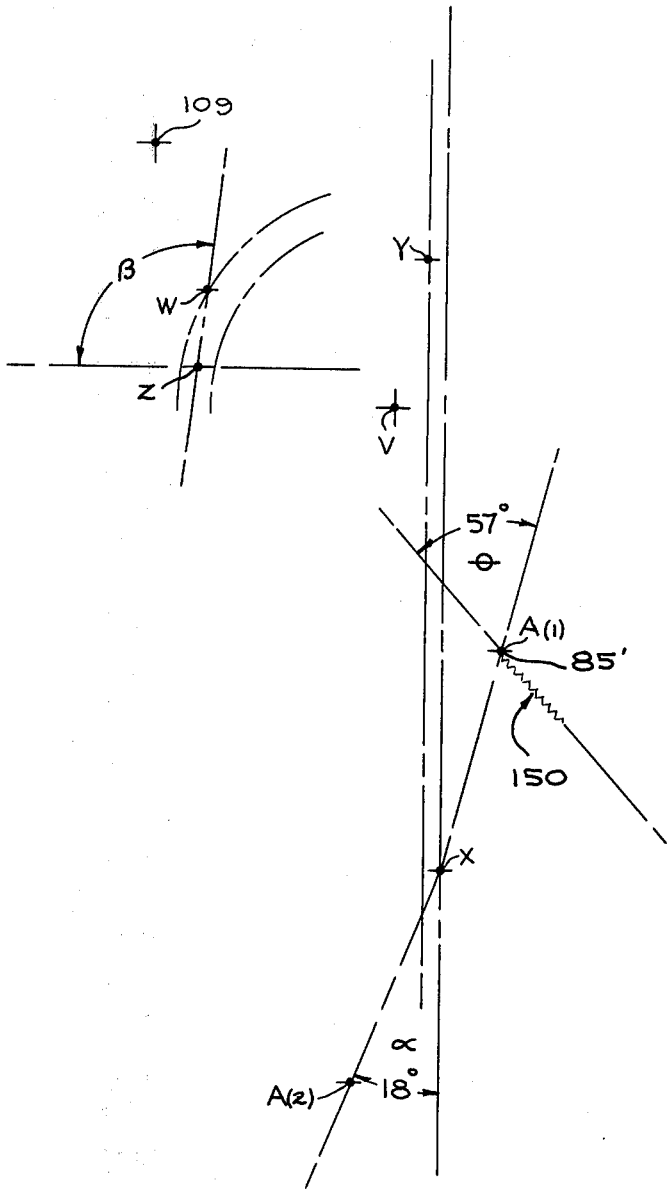
FIG. 5 is a free body schematic of the inventive apparatus illustrating various design parameters.

Referring to FIG. 5, point X corresponds to the center of shaft 66 and A (1) corresponds to point 85' of the detent means 80 when engaged as in FIG. 3, and point A (2) corresponds to point 85' when the detent means is in the position shown in FIG. 4. The grooves 85 are shown in phantom. Point Y corresponds to the center of cam 100, point Z corresponds to the center of pin 108, point V corresponds to the point where projection 112 engages cam 100, and point W corresponds to the point where spring 110 engages the follower 106. All points are shown schematically for purpose of illustration. Points X and Y are preselected to correspond to the design application and dispensing and timer-controlled cam environment of the particular washing machine used.

The angle theta ($\theta$) is defined by a line drawn through points X and A(1) and the line which represents the slope of the retaining surface 150 of the radially extending arm 84 of detent means 80. Given a predetermined spring force of spring 90 and a compressibility component exerted by gasket 74, as theta increases, it takes greater force to hold member 84 into engagement, and conversely as theta decreases it takes less force to hold member 84 into engagement. Therefore theta is chosen to give optimum tolerance take-up and give the operator optimum manual closing and opening torque on cup cover handle 70. In the preferred embodiment the maximum opening force required to open cover 64 once member 84 is engaged with cam follower 106 has been selected to be no greater than 15 inch pounds, which is also the maximum force desired to manually close the cup cover. In the preferred embodiment theta has been chosen to equal 57 degrees. Given a fixed theta required for a predetermined range of tolerance take-up, grooves 85 are formed in the surface 150 beginning at point 85' to facilitate a variation in the force necessary to hold member 84 into engagement, thus allowing a corresponding variation in the opening and closing torque required by the operator. One skilled in the art will appreciate that surface 150 could be designed to provide the same result without the use of grooves, for example, the surface could be formed in a generally concave, convex, hyperbolic or other configuration depending on the design parameters selected.

The radial extension 84 is located on hub 82 such that point A is not engaged by projection 114 of cam follower 106 until the operator has achieved minimally acceptable compression of gasket 74 thereby sealing container 62. The location of point A is best shown by referring to the angle alpha ($\alpha$) shown in FIG. 5, which angle is formed by a vertical line through point X and a line drawn through point X and point A(2). In the preferred embodiment alpha was chosen to equal 18 degrees, when the cover handle-open rotational angle has been selected to equal 166 degrees. The open rotational angle is chosen to give optimum detergent washout in the open position, and an additional rotational angle of 14 degrees has been provided to accommodate the compression of gasket 74.

Referring to FIG. 3, the engaging surface 152 of radial arm 84 is shown. The phantom view shows projection 114 of cam follower 106 engaging with surface 152 as the detent member is moved counterclockwise. It can be seen that surface 152 is slightly convex, and is of a length sufficient to provide for engagement with pawl 114 of follower 106 under maximum tolerance variation encountered during fabrication and assembly. Surface 152 is configured so that the operator incurs a minimal yet nearly constant engaging force. In the preferred embodiment the arcuate length of surface 152 is approximately 1.3 inches.

The timer control unit 54 has a cam member 100 which is mounted for rotation about shaft 104. Cam 100 has at least one recession formed therein 101 for a reason which will be later described. Mounted adjacent cam 100 is an elongated cam follower member 106 having a slot 107 formed therein for connection to a pin 108 which projects from the timer control escutcheon 31 of wall 30. Connected to the slot 107 at the upper portion thereof is a spring member 110 which is fastened to a pin 109 also projecting from escutcheon 31. Cam follower 106 has an extension 112 formed thereon which tracks the rotation of cam 100. Formed at the other terminal end of follower 106 is a projection 114 adapted to engage the grooved surface 85 of detent member 82. As can be better seen by reference to the arrow 4 of FIG. 4, cam follower 106 is permitted to rotate in a counterclockwise direction when the projection 112 falls within the recess 101 of cam member 100. When this occurs at a predetermined time in the wash cycle, projection 114 is lifted from the grooves 85 of detent 82 and the spring 90 causes the detent member 82 to rotate in a clockwise direction until the shoulder 87 abuts against the stop 94. This, of course, causes the cover 64 to rotate in a clockwise direction as shown in FIG. 3, thereby opening container 62 to the interior portion of the dishwasher 10.

Given the predetermination of the points X, Y and Z for a particular design application as dictated by a specific machine's specifications, the size and shape of the elongated cam follower 106, the spring force of spring member 110, and the size of cam 100 and the recess therein are appropriately chosen. Cam follower 106 is designed so that it can track cam 100 and engage and hold member 84. Since the forces required to perform these functions have opposing components in the vertical direction, slot 107 is designed to allow member 106 to pivot about point V, i.e., the point where projection 112 contacts cam 100, during the engagement of follower 106 and radial arm 84 as is shown in phantom in FIG. 3, and to permit pivoting about point Z when projection 112 falls into the recess 101 of cam member 100. The sides of slot 107 are concentric arcs drawn about point V as is shown in FIG. 5. This allows for cam follower 106 to pivot about point V without affecting the translation of projection 112 relative to the circumferential surface of cam 100. The radial depth of recess 101 is such that projection 114 is permitted to rise a sufficient distance above the radial length from X to A (1), thereby allowing member 84 to rotate under the force of spring 90 clearing projection 114 under maximum tolerance allowances.

Spring 110 is attached to slot 107 of follower 106 at a point W so that a counterclockwise moment of force is applied to follower 106 about point Z thereby causing effective engagement of projection 112 with cam 100. It is also necessary to have spring 110 provide a clockwise moment of force to follower 106 about point V in order to cause effective engagement and retention of radial arm 84. In order to satisfy the above design requirements the force vector caused by spring 110 must lie within the angle beta ($\beta$) referring to FIG. 5, beta defined by a horizontal line drawn through point W and by a line drawn through points Z and W when the bottom of slot 107 is in full engagement with the pin 108 and projection 112 is engaged with the bottom (smallest radial dimension) of recess 101 of cam member 100. Thus spring 110 is mounted to pin 109 which falls within the angle beta.

Operation of the novel dispensing mechanism will now be described. The operator opens the dishwasher door 28 and loads the dishes to be washed in the racks 22 and 24 in suitable fashion. At this time, the door 28 is in the substantially horizontal position and the detergent container 62 is uncovered. That is, the detergent cup cover 64 is in the dotted position as shown in FIG. 4. The operator then places detergent into the detergent cup 62 and into the open recess 76 in the dishwasher door. Handle 70 is then moved in a counter-clockwise direction as shown in FIG. 4 into the closed but unsealed position shown in FIG. 2. By this motion any excess detergent which may have been placed in container 62 is sheared off by the rotating motion of the cover 64. Upon further rotation of handle 70 the cam follower 106 engages the detent member 82 by interaction of the projection 114 and the grooves 85 of arm 84. That is, pin 71 is caused to coact against the inclined slot 65 in the cover 64, causing the cover to translate in the axial direction as shown by arrow 2 of FIG. 2. This additional rotational motion causes the projection 114 to move along the grooved surface 85 beginning from point 85' as detent member 82 moves in a counter-clockwise direction as seen in FIG. 3. Thus, once engagement of projection 114 with grooves 85 is accomplished, the handle is held in the position shown in FIG. 3. The axial movement of cover 64 forces the rubber seal 74 into a tight sealing relationship with the projection 63. Spring 110 holds projection 114 into grooves 85 by pivoting follower 106 about projection 112 as explained above.

The detergent in the stationary open cup 76 is normally used in the first wash. Normally there are then one or more rinses. This, of course, depends on the operator setting of the control knob 56 which is connected to the timer control unit 54. At the beginning of the second wash cycle, the cam 100 is moved into the position shown in FIG. 4. At this time the follower 106 is caused to slide into the recess 101 under the upward force of spring 110, causing the projection 114 to move upwardly and away from the grooves 85 of radial extension 84 of the detent member 82. As this occurs, the detent member 82 moves in a clockwise direction as shown in FIG. 4 into abutting engagement with the stop 94 which, in turn, uncovers the detergent container 62. The detergent within the detergent container 62 is then allowed to mix with the second wash water for a more thorough washing of the dishes contained therein. When the second wash is over, there are several rinses and the Calrod heater is normally energized to dry the dishes. The cover remains in the dotted position shown in FIG. 4 so that container 62 may be filled for the succeeding dish load.

It should be appreciated that with this invention the handle and its shaft, the cover 74 and the detent member 82 may be assembled through the inner door wall 30 in one step in the assembly process. The spring 90 which is normally preassembled to the detent member 82 through the hole 81 is then caused to wrap around the pin 92, causing the shoulder 87 to abut against the stop 94. In a separate assembly step which may occur any time in the assembly process, the cam follower 106 is placed over the pin 108 and the spring 110 is connected to the pin 109 and cam follower 106. The apparatus is now ready to operate and there is no further need to attach any complicated or complex electrical, electromechanical or mechanical mechanism between the timer control member and the detent member 82. The slot and spring arrangement of cam follower 106 as was described above, provides the necessary "free play" required for both assembly and operation of the detent member 82.

The simple design of this invention having relatively few moving parts, lends itself to fabrication by inexpensive plastic injection molding techniques. Further, the mechanism according to this invention provides for wide manufacturing tolerances and yet accomplishes a tight seal when the detergent cup cover is closed. Because of the design and character of the gasket 74, a tight seal thereby preventing clogging of the granular detergent is always assured regardless of any warppage that may occur as the machine gets older. For details of the handle and cover arrangement reference should be made to copending application Ser. No. 798,972. With this mechanism, overfill of detergent in cup 62 is not a problem since excess detergent is sheared from the top of the cup when the lid is closed, as shown in FIG. 2. With this invention, the inherent excellent sealing function of a soft rubber gasket is achieved, with provision made for effectively breaking the "seal" by the axial motion caused by the interaction of the inclined pin 71 with the inclined slot 65 formed in the cover 64.

Prior art devices normally called for either the factory assembler or the service technician to manually connect the linkage from the timer mechanism to the detergent dispensing apparatus. This operation could be tedious and was always time consuming. As was discussed above, the need for performing this function has been eliminated with our invention.

Modifications may be made in the invention without departing from the spirit of it. For example, it will be understood by one skilled in the art that the actuating mechanism of the present invention may be used with any suitable type of dispenser means for either a top-loading or a front-loading dishwashing machine, wherein the actuation of the dispenser depends upon the rotation of a shaft. The actuating mechanism is simple, compact, and, depending upon the type of dispenser used, may be located substantially anywhere in a dishwashing tub between the interior wall portion and the outer casing.

The embodiments of the invention in which an exclusive property is claimed are defined as follows:

We claim:

1. An improved apparatus for dispensing additive into a wash chamber of a dishwasher having a timer control unit, an additive storage container with a rotatable cover and handle therefor, cam means in communication with said timer control unit, said apparatus being mounted between the inner and outer walls of a door of said dishwasher, the improvement comprising:

means for biasing said cover toward an open position in which said container is uncovered, detent means for holding said cover in a sealed position in which said cover seals said container, said detent means being fixedly attached to said cover handle for rotation therewith, said detent means including a radially extending arm having an engaging surface and a retaining surface formed thereon, cam follower means operably connected to said cam means for movement between an engaging position in which said follower means engages said engaging and retaining surfaces and holds said retaining surface, and a release position removed from said surfaces in which said follower means releases said retaining surface, in response to motion of said cam means, thereby uncovering said container at the appropriate time in the washing cycle as determined by said control timer unit, said cam follower means including a first pin projecting from said inner door wall, and an elongated member slidably mounted at one end thereof to said first pin, said first pin being disposed adjacent said cam means, and said retaining surface being sloped such that a predetermined angle is formed by the intersection of a line representative of the slope of said retaining surface and a line passing through the center of rotation of said detent means and a leading edge of said retaining surface as said surface moves into initial engagement with said follower means, said angle being selected such that the retaining force required to hold said surface is optimized to accommodate wide manufacturing and assembly tolerances.

2. The apparatus of claim 1 wherein said engaging surface is contoured to cause the engaging force exerted on said engaging surface by said follower means to be minimum and constant, and said engaging surface is of sufficient length to allow engagement therewith by said follower means within wide manufacturing and assembly tolerances.

3. The apparatus of claim 1 additionally including a first projection extending from said elongated member and operable to engage and thereby track said cam means.

4. The apparatus of claim 3 additionally including a second projection extending from the free and of said elongated member and operable to move between said engaging position and said release position.

5. The apparatus of claim 4 wherein said elongated member is positioned between said cam means and said arm, said member operable to pivot about said first projection when said second projection abuts said engaging surface of said arm when the cover is rotated to its closed position.

6. The apparatus of claim 5 including further a second pin projecting from said inner door wall, a second spring member connecting said second pin and the slidably mounted end of said elongated member, said second spring member operable to hold said second projection into engagement with said retaining surface of said arm by pivoting said elongated member about said first projection.

7. The apparatus of claim 6 wherein said second spring member holds said first projection of said elongated member into engagement with said cam means.

8. The apparatus of claim 6 wherein said second pin is disposed within an angle defined by a first line drawn horizontally through a first point where said second spring member is connected to said elongated member, and a second line drawn through the center of said first pin and extended through said first point when said elongated member is fully engaged with said first pin and when said free end of said elongated member is in said release position, thereby positioning the force vector provided by said second spring member within said angle.

* * * * *